US005680838A

United States Patent [19]

See et al.

[11] Patent Number: 5,680,838

[45] Date of Patent: Oct. 28, 1997

[54] SWIVEL FOOT LASH ADJUSTER

[75] Inventors: Gary Eugene See, Wyoming, Mich.; John Joseph Burns, Geneva, N.Y.

[73] Assignee: General Motors Corporation, Detroit, Mich.

[21] Appl. No.: 731,801

[22] Filed: Oct. 21, 1996

[51] Int. Cl.[6] ..... F01L 1/24

[52] U.S. Cl. ..... 123/90.46; 123/90.55

[58] Field of Search ..... 123/90.34, 90.43, 123/90.45, 90.46, 90.48, 90.49, 90.51, 90.55; 74/569, 519, 559

[56] References Cited

U.S. PATENT DOCUMENTS

| | | | |
|---|---|---|---|
| 4,570,582 | 2/1986 | Speil | 123/90.46 |
| 4,708,103 | 11/1987 | Speil | 123/90.46 |
| 4,729,350 | 3/1988 | Speil | 123/90.46 |
| 4,815,424 | 3/1989 | Buuck et al. | 123/90.46 |
| 4,856,468 | 8/1989 | Speil et al. | 123/90.46 |
| 5,609,133 | 3/1997 | Hakansson | 123/90.46 |

*Primary Examiner*—Weilun Lo

*Attorney, Agent, or Firm*—Karl F. Barr, Jr.

[57] ABSTRACT

A valve actuation assembly for an internal combustion engine is disclosed in which a rotatable rocker arm assembly is actuated by an engine driven camshaft to move a poppet valve reciprocably. The rocker arm assembly includes a hydraulic lash adjuster for disposition between the rocker arm and the valve stem. The lash adjuster includes an actuator at one end having an axially extending neck which terminates in an enlarged head. The enlarged head engages a foot assembly which includes a disk having a socket in which the head is positioned. Retention of the foot member to the enlarged head is through an interference between the perimeter of the enlarged head portion and the socket opening which is defined by a radially inwardly extending flange. Assembly of the foot member onto the enlarged head portion of the lash adjuster body is through a differential heat and/or cooling of the components which causes the interference to be temporarily eliminated through thermal expansion and/or contraction of the two components allowing the head portion to be inserted into the socket. Following assembly, the thermal differential is eliminated and the interference is re-established, permanently fixing the foot member to the lash adjuster body.

3 Claims, 4 Drawing Sheets

SWIVEL FOOT LASH ADJUSTER

TECHNICAL FIELD

The invention relates to hydraulic lash adjusters for internal combustion engines.

BACKGROUND OF THE INVENTION

The desirability of reducing frictional loss at the interface between the rocker arm and the stem end of an associated poppet valve member while minimizing lash between such valve components during the operation of an internal combustion engine is recognized. One proposed solution to such problem as disclosed, for example, in U.S. Pat. No. 4,708,103 issued Nov. 24, 1987 to Walter Speil, is by the use of a hydraulic lash adjuster operatively positioned in the valve actuator arm portion of a rocker arm. The follower body of the lash adjuster has a semi-spherical, closed end that is operatively associated with a separate semi-spherical socket provided in one side of a disc shaped, foot member. The opposite surface of the foot member is configured with a flat surface so as to engage the corresponding flat, stem end of an engine valve. A cage member engages, and extends downwardly from, the exterior of the follower body of the lash adjuster to engage the outer surface of the foot member with a radially inwardly directed flange which is operable to retain the foot member in association with the semi-spherical end of the follower body. In such a valve train arrangement, the cage member, located externally of the follower body, is subject to external influences which may inflict damage. Such external influences may include contact between the foot member and the cage, when the components are at maximum relative angles. Such contact may present the cage member as the defining component for maximum swing angle resulting in the potential for accelerated wear or component fatigue. Additionally, the external mounting of the cage member to the follower body may act to interfere with the flow of lubricating oil along the outer follower body surface and to the interface of the spherical projection and the foot member.

In addition to the structural limitations inherent in the cage member foot retainer, significant handling and cost penalties are involved in the use of a retainer to maintain foot contact with the follower body.

SUMMARY OF THE INVENTION

The present invention relates to a hydraulic lash adjuster of the type which may be mounted within a rocker arm and includes a ball and socket assembly interposed between the follower body and the valve stem. A primary object of the invention is to provide an improved hydraulic lash adjuster wherein the body of the lash adjuster includes a semi-spherical or semi spheroidal actuator end that is in substantial rolling contact within a socket provided in a foot member. Due to the pivoting geometry created by the design of the rocker arm and the angle of the associated valve member, the foot member is configured to maintain contact between the valve tip and the lash adjuster body through a pivoting action with a minimization of sliding or scrubbing at the valve tip surface. The foot member is configured such that the inner diameter of the socket opening is smaller than the spherical end of the lash adjuster body while the inner dimension of the socket allows free swivel motion of the body within the foot without contact. A small diameter socket opening relative to the spherical end of the body allows assembly of the foot to the body using an interference fit thereby eliminating the use of a retainer.

By holding the foot outer diameter and the socket inner diameter to close tolerance, the components may be assembled using a differential temperature operation to vary the relative part dimensions allowing a slip fit. Following normalization of the components' relative temperatures, the parts are retained through the described interference fit.

It is a further object of the present invention to provide a hydraulic lash adjuster having improved lubrication at the interface of the lash adjuster body with the socket of the foot member. External cage-type retainers operate to interfere with the flow of lubricating oil along the outer surface of the body and, subsequently to the semi-spherical actuator. By eliminating the retainer assembly between the body and the socket portion of the foot member a lubrication flow path is defined.

In a preferred embodiment of the invention, the retainer assembly is configured and assembled to the foot member so as to provide a desired angular rotation, or swing angle, of the foot relative to the follower body while avoiding contact with the body. Absence of contact between a retainer assembly and the body limits retainer wear and fatigue.

The details, as well as other features and advantages of the invention are set forth in the following detailed description and drawings.

DESCRIPTION OF THE PREFERRED EMBODIMENT

Figure 1:
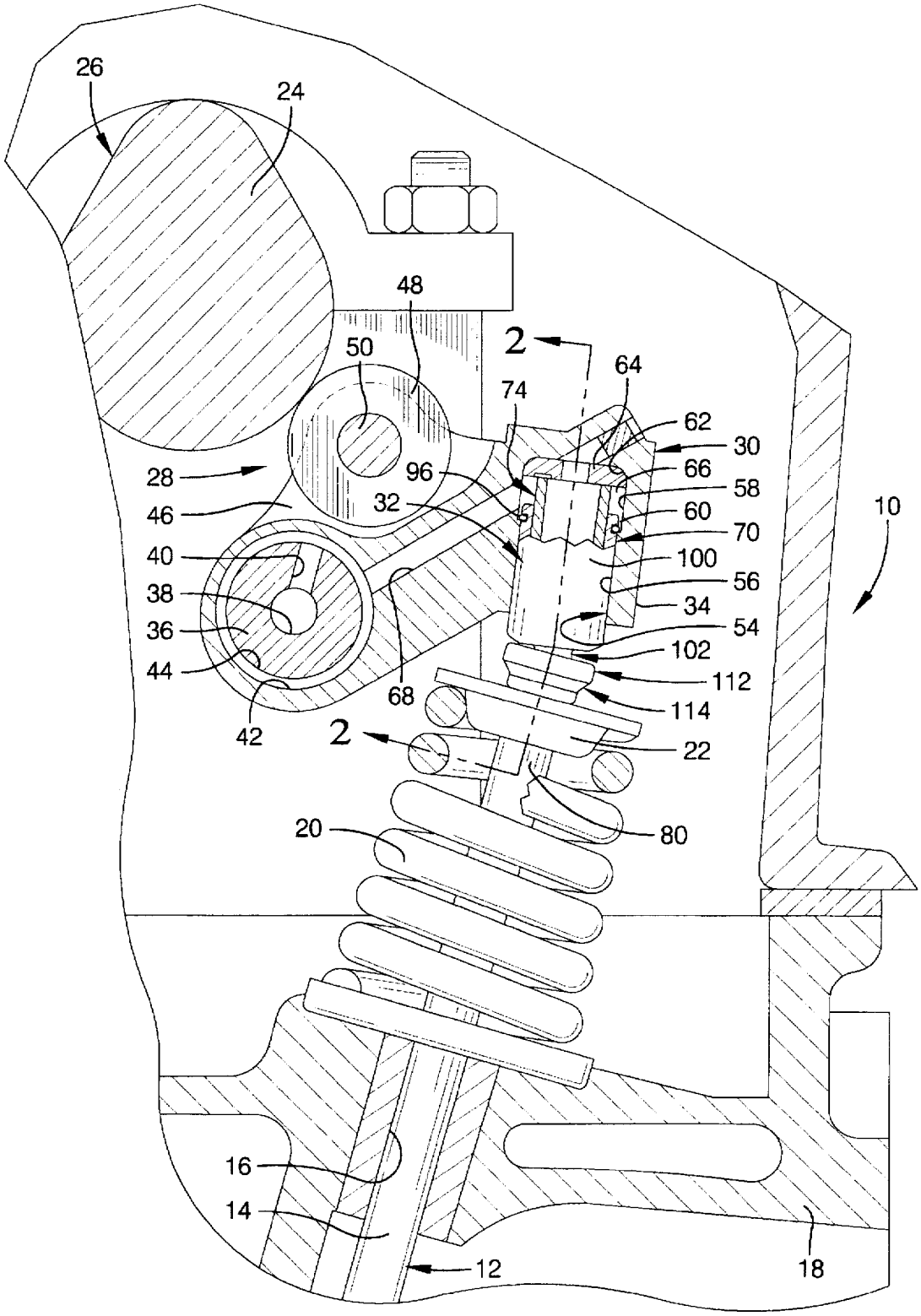
FIG. 1 is a partial, sectional view of an internal combustion engine which embodies features of the present invention.

Referring to FIG. 1, there is shown a portion of an internal combustion engine, designated generally as 10, which includes a poppet valve 12 having a stem 14, supported in guide bore 16 in cylinder head 18. Valve 12 moves reciprocally to open or close a port, not shown, which can be either an inlet or an exhaust port. The stem 14 of the poppet valve 12 is normally biased to a valve closed position by a valve return spring 20 disposed coaxially about the stem 14. One end of the return spring 20 is supported by an upper surface of the cylinder head 18 while the opposite end of the spring 20 engages a suitable retainer 22 fixed, in a conventional manner, to the stem.

The stem 14 of the poppet valve 12 is operated on by a cam 24 on a camshaft 26 via a rocker arm assembly 28. The rocker arm 30 of rocker arm assembly 28 is rotatably supported above the cylinder head 18 on a rocker shaft 36 and includes a valve actuator arm 34 which overlies the stem 14 of the poppet valve 12. A hydraulic lash adjuster 32 is received within a stepped bore 54 in the valve actuator arm 34 and operates as an interface between the valve stem end 80 and the rocker arm assembly 28 to take up lash therebetween.

The rocker shaft 36 is supported above the cylinder head and includes an axially extending bore 38 which is in continuous communication with pressurized lubricant supplied by the engine 10. The rocker shaft 36 is provided with at least one rise passage 40 for each rocker arm 30 that communicates with an annular groove 42 provided in either the outer peripheral surface of the rocker shaft 36 or, as shown, in the inner peripheral surface of the bore 44 of the rocker arm 30.

In the construction illustrated, the cam actuated rocker arm 30 is bifurcated intermediate of its ends to define spaced apart roller supports 46, so as to loosely receive a cam follower roller 48 rotationally supported on a shaft 50 fixed in and extending through suitable apertures provided for this purpose in the roller supports 46.

Rocker arm 30 is provided with stepped bore 54 so as to define in succession, starting from the lower end as viewed in the ures, a cylindrical follower body guide wall 56 and an upper wall 58. The follower body guide wall 56 is of a diameter less than that of the upper wall 58 and is connected to the upper wall by a shoulder 60.

The upper end 62 of the stepped bore 54 is substantially closed by means of a disc 64 that is positioned within the upper wall portion 58 in abutment with the upper end 62. The lower surface of the disc 64 forms, with the upper wall 62, a fluid reservoir 66 which is in flow communication via a passage 68 which extends from the upper wall 58 through the rocker arm 30 to intersect groove 42 and establish fluid communication with the engine lubricant supply in the rocker shaft 36.

Figure 2:
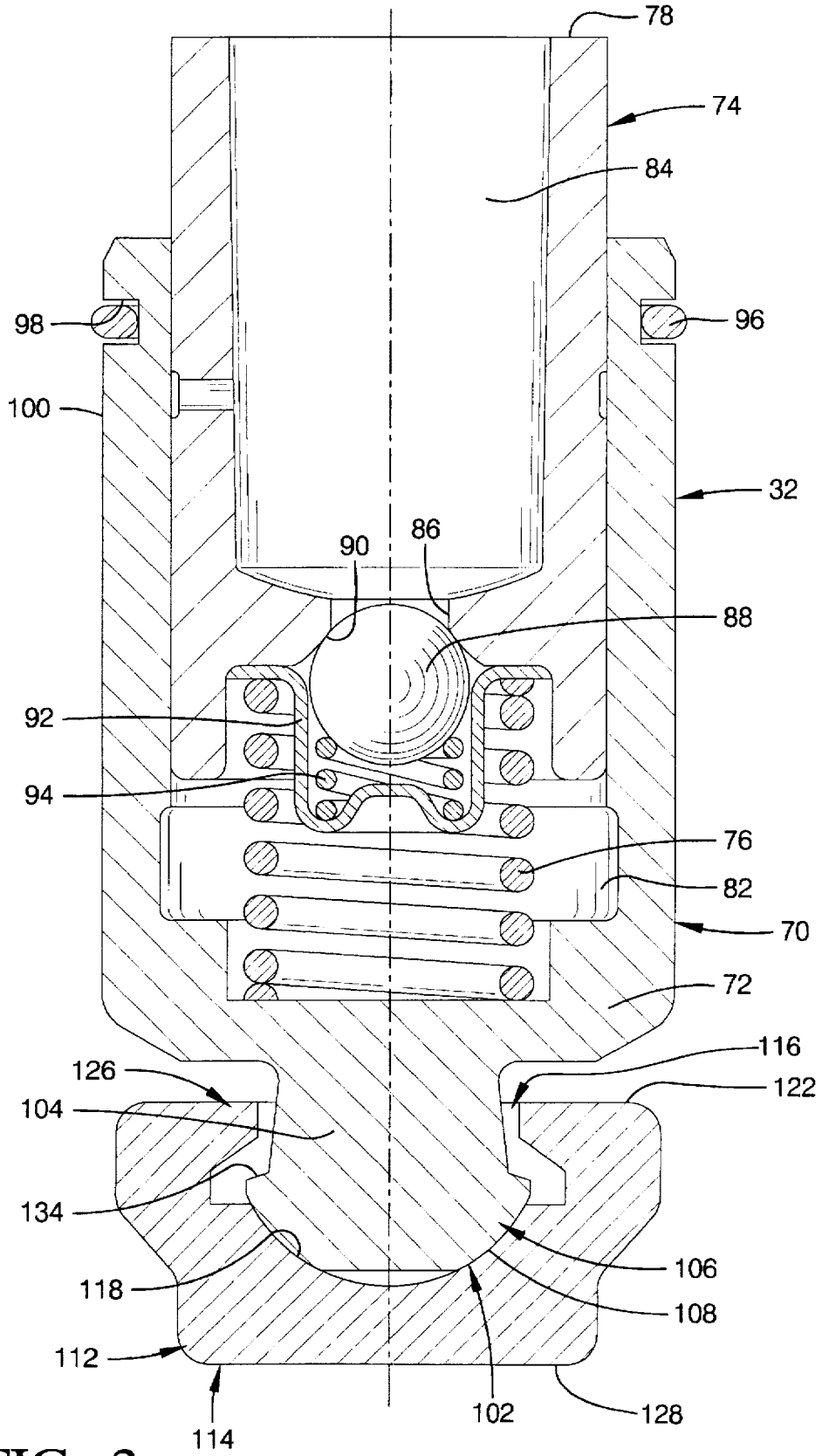
FIG. 2 is a sectional view of the hydraulic lash adjuster illustrated in the engine of FIG. 1, taken along line 2—2.
Figure 3:
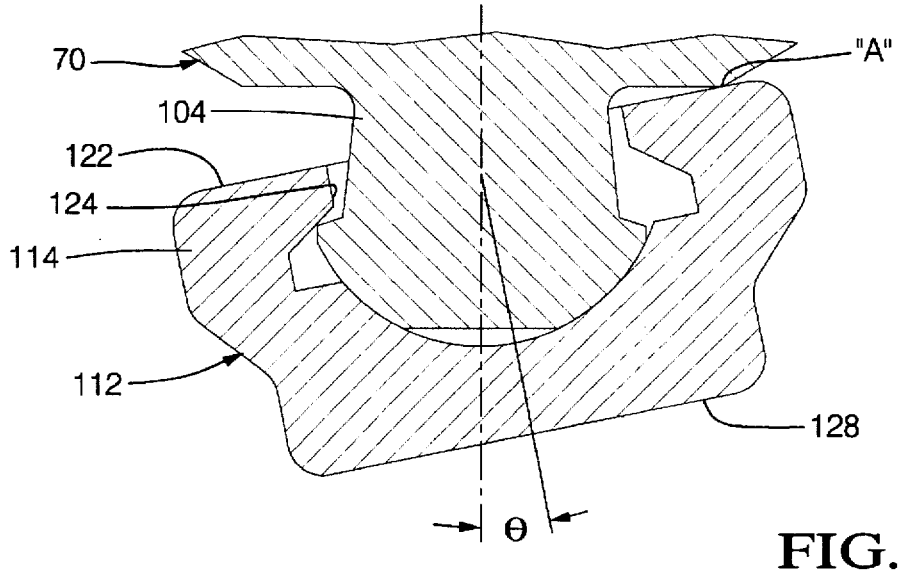
FIG. 3 is an enlarged view of a portion of the hydraulic lash adjuster illustrated in FIG. 2.

The hydraulic lash adjuster 32, shown in detail in FIGS. 2 and 3, except for the specific construction of the closed end of the follower body 70, is of substantially conventional construction and includes cup shaped, cylindrical follower body 70, having a closed end 72, that is slideably received in the follower guide wall 56 of the stepped bore 54. A plunger or piston 74 is disposed within the cylindrical follower body 70 for reciprocation therein, and is normally biased upwardly by a plunger spring 76 so that its upper end 78 abuts against the lower surface of the disc 64, FIG. 1. The plunger spring 76 also acts against the closed end 72 of the follower body 70 so as to maintain the closed end of the hydraulic lash adjuster 32 in operative engagement with the terminal end 80 of the poppet valve stem 14.

The lower end of the plunger 74 forms, with the closed end of the follower body 70, a pressure chamber 82 while the upper, open end of the plunger 74 defines a supply chamber 84 that is in continuous flow communication with the fluid reservoir 66. The supply chamber 84 is in flow communication with the pressure chamber 82 via a port 86, flow though which is controlled by a one-way valve in the form of a ball 88 which closes against a seat 90 disposed about the port 86.

A suitable valve cage 92 and valve return spring 94 limits open travel of the valve ball 88 to that necessary to accommodate replenishment of the pressure chamber 82 with oil which normally escapes therefrom between the sliding surfaces of the plunger 74 and the follower body 70 as "leak-down" during cam induced opening movements of the stem 14 of the poppet valve 12. The valve cage 92 is held in position against the plunger 74 by the plunger spring 76, or alternatively, the valve cage 92 may be held as by an interference fit to the plunger 74.

The hydraulic lash adjuster 32 is axially retained, for limited movement within the stepped bore 54 by means of a retainer ring 96 located in annular groove 98, provided for this purpose, in the outer peripheral surface 100 of the follower body 70, whereby the retainer ring 96 registers with the shoulder 60 to thereby limit the downward travel of the follower body 70, as viewed in FIG. 1.

In the embodiment shown in the ures, the follower body 70 of the hydraulic lash adjuster 32 has its closed end provided with a depending actuator 102 that includes an axially extending neck portion 104 terminated, at its lower end, with an enlarged diameter actuating head 106 which includes a semi-spherical or semi-spheroidal actuating surface 108.

Foot member 112 is in the form of a circular disc 114 having, on one side thereof, a socket 116 defined by a semispherical lower surface 118 having radii which are complementary to the radii of the actuating surface 108 of the actuating head 106 of the follower body 70. Surrounding the semispherical lower surface of the socket 116 is an axially extending, cylindrical wall 120 which terminates at its upper end, as viewed in the ures, in a radially inwardly extending flanged portion 122 which defines an opening 124 therein. The top surface of the flanged portion 122 defines the upper surface 126 of the disc 114. A flat surface comprises the second, lower surface 128 of the circular disc 114 and is configured for contact with the terminal end 80 of the valve stem 14 of the poppet valve 12.

The diameter of the opening 124 is such that an interference fit is established with the outer perimeter surface 130 of the actuating head 106 to define a foot member 112 which can be installed over the head such that the opening 124 loosely encircles the axially extending neck 104 of the actuator 102. Movement of the foot member 112 off of the actuator 102 is prevented by contact between the radial flange portion 122 and the back 132 of the enlarged diameter actuating head 106 as the opening 124 is of a smaller diameter than that of the head.

Figure 4:
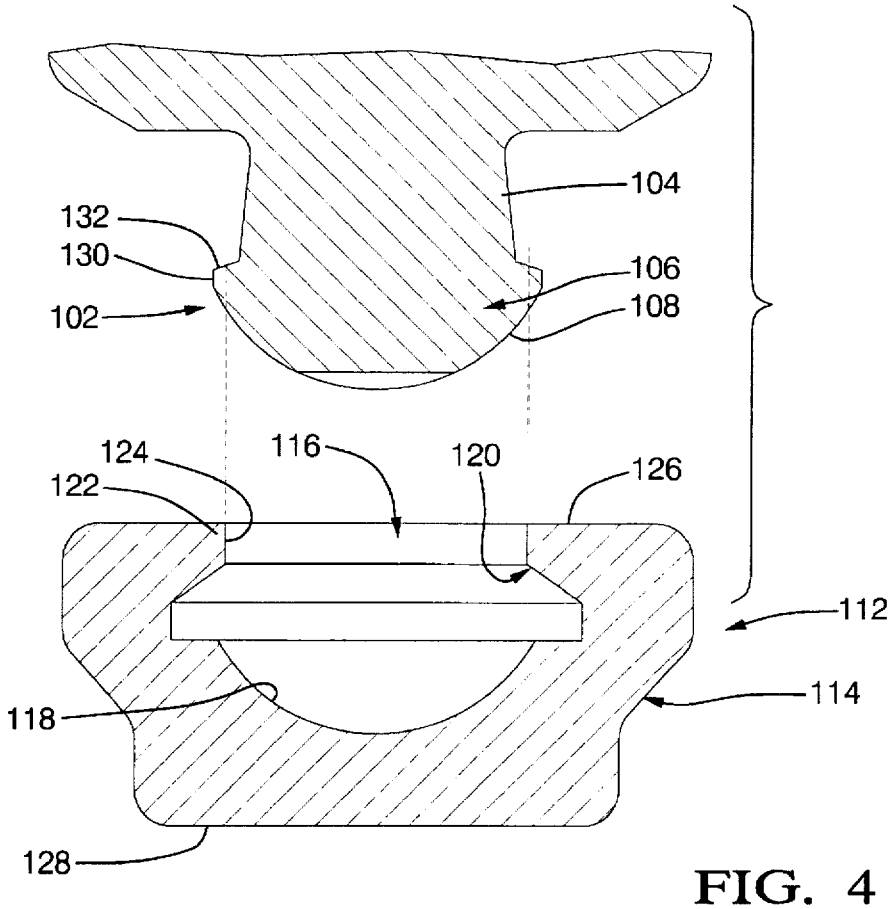
FIGS. 4, 5 and 6 show the assembly steps of a portion of the hydraulic lash adjuster of FIG. 2.
Figure 5:
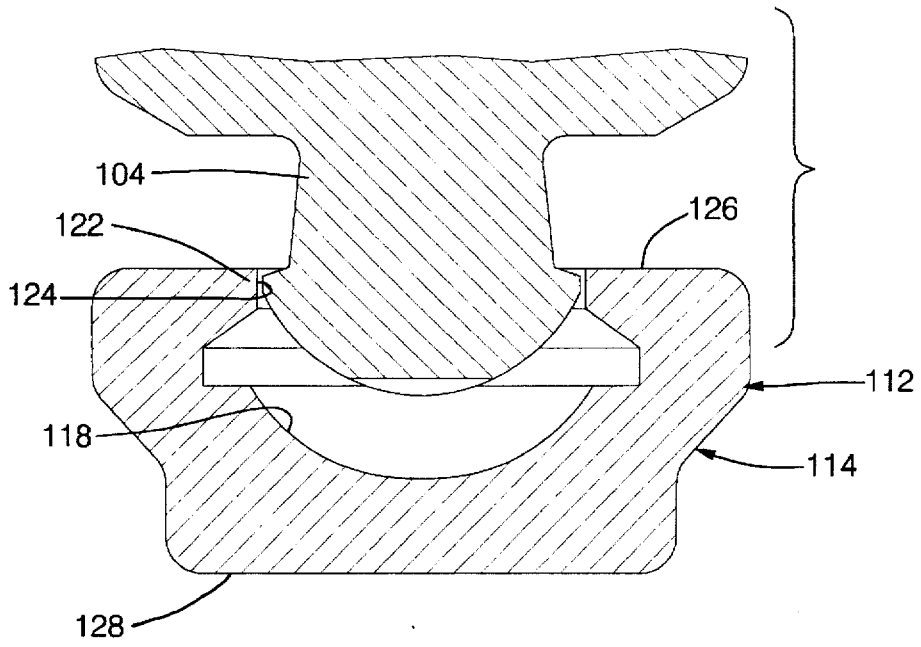
Figure 6:
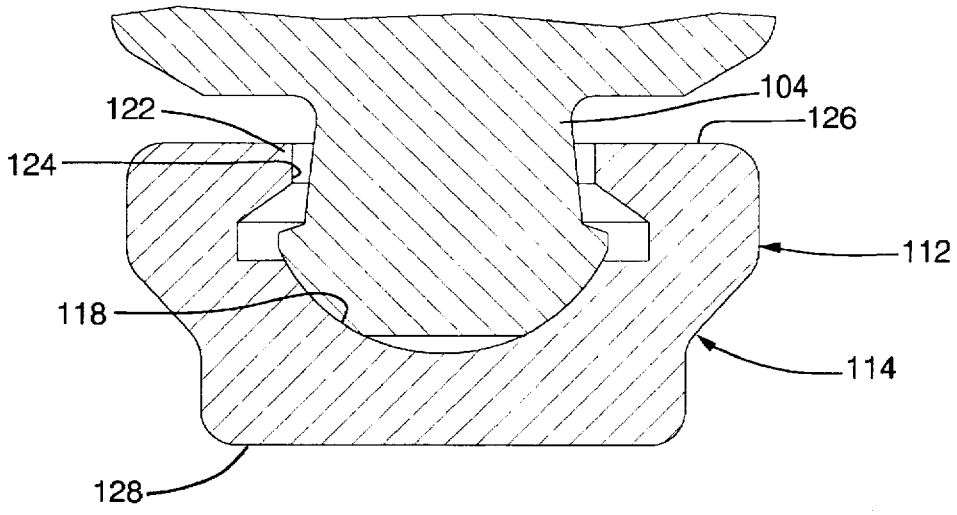

FIGS. 4, 5 and 6# illustrate the assembly of the foot member 112 to the enlarged diameter actuating head 106 of the depending actuator 102. In FIG. 4 the components are shown prior to assembly at which time the foot member 112 is subjected to a heating process causing thermal expansion of the member and, preferably, an increase in the diameter of opening 124. Concurrently with the heating operation of the foot member, the actuating head 106 of the depending actuator 102 is subjected to a cooling operation which operates to impart a dimensional reduction in the outer perimeter surface 130. The heating and cooling processes to which the components 114 and 106 are subjected establish a thermal differential between the parts. By controlling the size and tolerance of the opening 124 of the foot member 112 and the outer perimeter surface 130 of the actuating head 106, dimensional changes due to the thermal expansion and contraction of the components will facilitate a "slip fit" therebetween such that the foot 112 can be assembled over the head 106, FIGS. 5 and 6. As the parts are allowed to reach ambient temperature, eliminating the temperature differential between the foot member 112 and the enlarged head 106, an interference, FIG. 6, is established between the opening 124 of foot member 112 and the outer perimeter surface 130 of the actuating head 106 to thereby prevent the foot member from being disengaged from the follower body 70.

It should be noted that assembly of the foot member 112 to the follower body 70 does not necessarily require the use of both a chilling operation on the enlarged head 106 and a heating operation on the foot member 118. Temperature differential between the two components must be sufficient to achieve the desired dimensional changes required to allow assembly of the parts. Such dimensional changes must include consideration of machining tolerances on the mating diameters as well as the change in temperature allowable, subsequent to removal from the heating or cooling environment and prior to assembly. Either method alone may reduce the interference dimensions to a workable fit.

The use of such an interference fit between the foot member and the enlarged diameter actuating head of the follower body eliminates the external cage member which is typically used to retain such a foot in engagement with the body as well as eliminating secondary staking or rolling type operations to fix the foot member to the body as is typically used with retainerless designs.

Lubrication of the surface 118 of socket 116 and the corresponding surface 108 of the enlarged actuator head 106 is by oil leakage primarily from between the guide wall 56 and the outer peripheral surface 100 of the follower body 70 or, by splash lubrication in a manner well known in the art. Elimination of an externally carried cage for supporting the foot member provides a distinct advantage in lubricating this interface as it provides an unobstructed flow path for lubricating oil to flow along the outer surface of the follower body 70 including the neck 104, and into the socket 116

Operation of the internal combustion engine 10 will result in pivotal movement of the rocker arm 30 from a valve closed position to a valve open position. The effective operative contact point between an associate element of the valve actuator arm and the terminal end 80 of the valve stem 14 will move laterally across the stem terminal surface. The foot assembly 112, being loosely disposed about the neck 104 of the actuating head 106 of the follower body 70, allows for pivotal movement between the complementary semispheroidal surfaces of the foot socket 116 and the actuator 106 allowing for relative angular movement between the lash adjuster body 70 and the foot assembly 112 to thereby reduce scrubbing engagement between the lash adjuster 32 and the valve stem 14. With the cageless retention of the foot member to the follower body 70, a proper degree of relative swing angle θ between the foot 112 and the body 70, FIG. 3, is provided for without concern for potentially damaging or wear inducing contact between a retainer cage and the body. As can be seen from the illustration of FIG. 3, the configuration of the foot member 112 allows the lower surface of the body 70 to contact the annular land 122 of the disc 114, location "A", thereby providing maximum angular travel between the associated components.

Similarly, the neck 104 of the follower body 70 may include a radially inward taper, or back taper, in the upward direction, as viewed in FIG. 3. The back taper allows the foot assembly to swing through its maximum desired angular displacement relative to the follower body 70. Taper of the actuator neck 104 has the advantage of contributing to minimized contact between the foot member 112 and the lash adjuster body 70 while also functioning to maintain the foot assembly 112 in place during shipping of the part when the unloaded foot assembly 112 may be allowed to hang from the enlarged actuator head 106. In such an instance the larger neck diameter adjacent the enlarged head portion 106 cooperates with opening 124 to prevent the foot assembly 112 from achieving sufficient lateral movement to become dislodged.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A hydraulic lash adjuster for disposition between a rocker arm and a valve stem of an internal combustion engine comprising a body having an actuator disposed at a first end, said actuator comprising an axially extending neck terminating in an enlarged head portion having an outer perimeter defining a first diameter, said lash adjuster further comprising a foot assembly comprising a disc member having a first surface which includes a socket and a second, flat surface, said socket having an opening in said first surface defined by a radial flange, said opening having a diameter less than the diameter of said perimeter of said enlarged head of said actuator, said socket configured to receive said enlarged head portion therein such that said foot assembly is prevented from dislocation off of said head portion by an interference between said flange defined opening and said outer perimeter.

2. A hydraulic lash adjuster, as defined in claim 1, said enlarged head portion of said actuator moveable within said socket to allow angular movement of said foot member relative to said body.

3. A hydraulic lash adjuster for disposition between a rocker arm and a valve stem of an internal combustion engine comprising a body having an actuator disposed at a first end, said actuator comprising an axially extending neck terminating in an enlarged head portion having an outer perimeter defining a first diameter, said lash adjuster further comprising a foot assembly comprising a disc member having a first surface which includes a socket and a second, flat surface, said socket having an inner surface configured to complement said enlarged head portion to thereby allow sliding relative motion therebetween, a cylindrical wall portion extending from said inner surface and having a first diameter and an opening through said first surface defined by an inwardly directed, radial flange, said opening having a diameter less than the diameter of said cylindrical wall and less than the first diameter of said enlarged head of said actuator, said socket configured to receive said enlarged head portion adjacent said cylindrical wall portion and below said flange defined opening, such that said foot assembly is prevented from dislocation off of said head portion by an interference between said flange and said outer perimeter.

* * * * *